US006263827B1

(12) United States Patent
Szigeti

(10) Patent No.: US 6,263,827 B1
(45) Date of Patent: Jul. 24, 2001

(54) FOLDING KAYAK

(75) Inventor: Darryl Szigeti, Budapest (HU)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 09/639,557

(22) Filed: Aug. 16, 2000

(30) Foreign Application Priority Data

Jul. 21, 2000 (FR) ..... 00 09617

(51) Int. Cl.[7] ..... B63B 35/00
(52) U.S. Cl. ..... 114/354; 114/347
(58) Field of Search ..... 114/347, 352–354

(56) References Cited

U.S. PATENT DOCUMENTS 4,841,899 * 6/1989 Fleckles et al. ..... 114/347
5,915,327 * 6/1999 Elvestad ..... 114/347

* cited by examiner

*Primary Examiner*—Ed Swinehart
(74) *Attorney, Agent, or Firm*—Dean W. Russell; Kilpatrick Stockton, LLP

(57) ABSTRACT

Kayak comprising: a rigid base in several sections end to end joined to one another in a water-tight hinge-mounting so that they can be folded one on top of the other; a rigid keel in several sections spanning the hinge-mountings of the base sections and retained in brackets fixed to said base sections; two pneumatically inflatable sides joined at the base to the longitudinal edges of the rigid base; a covering canvas joined to the respective top longitudinal edges of the two inflatable sides and having at least one opening for a user; a seat located under this opening; and at least one rigid tensioning frame arranged to the rear of the opening and designed to brace the base, the inflatable sides and the covering canvas.

10 Claims, 2 Drawing Sheets

FOLDING KAYAK

FIELD OF THE INVENTION

The present invention relates to improvements made to kayaks.

DESCRIPTION OF THE PRIOR ART

Rigid kayaks are already known, in particular made from wood or a plastics material, but all have the disadvantage of being difficult to transport because of their all-in-one structure and their heavy weight. It is not easy for a single person to carry such craft.

Other designs of kayak are known which can be dismantled and carried by an individual. However, these known craft have the disadvantage of being very complex in structure with a large number of pieces which have to be assembled so that assembly takes a very long time.

Pneumatically inflatable kayaks are known which have the advantage of being light and requiring little space when deflated and folded, which makes them easy to transport, but their navigability characteristics during use are poor. Craft of this type are mainly reserved for play and for children.

SUMMARY OF THE INVENTION

There is a high demand for kayaks which are quick and easy to dismantle and can be folded to a pack that can be carried on a person's back and which have excellent navigation qualities during use (directional stability, speed, . . . ).

The objective of the invention is to meet this specific need, which is not satisfied by the known designs of kayak, and to propose an original structure for a kayak.

To this end, the invention proposes a kayak which is characterised in that it comprises:

- a rigid base, made from several sections end-to-end joined in a water-tight hinge-mounting with one another so that they can be folded one on top of the other,
- a rigid keel made up of several sections spanning the hinge-mountings of the base sections and retained in brackets fixed to said base sections,
- two pneumatically inflatable side sections joined at the base to longitudinal edges of the rigid base,
- a covering canvas joined to the respective top longitudinal edges of the two inflatable sides, said covering canvas having at least one opening for a user,
- a seat located underneath said opening and
- at least one rigid tensioning frame arranged at the rear of the opening and designed to brace the base, the inflatable sides and the covering canvas.

The kayak outlined above with a combined architectural design incorporates all the advantages desired by users.

The rigid base has a perfectly smooth and non-deformable gliding surface which facilitates high speeds. This base also provides a stiffening element which, in conjunction with a finely streamlined shape at the ends, imparts good directional stability to the craft. The pneumatically inflatable sides afford excellent floating properties, making it impossible to submerse the craft during practical use.

The combination of a rigid element split into parts (the rigid base) and flexible elements made from waterproof fabric (deflated sides, covering canvas) allow the craft to be folded up to form a lightweight pack requiring reduced space which will easily fit into one person's back-pack.

Finally, the craft comes apart into a very small number of constituent parts (in practice nine components for a one-man kayak) which are easy to assemble and dismantle, so that the craft can be very quickly assembled and taken apart (in practice in about 10 minutes).

In a preferred embodiment, each inflatable lateral side-piece consists of several tubes one above the other: consequently, each tube can be designed with an appropriate tapered shape, particularly at the ends, so that the assembly will exhibit the desirable streamlining.

Also in a preferred embodiment, the water-tight hinge-mountings of the successive base sections consist of strips of impermeable fabric joined to the adjacent edges of two consecutive sections; a base can therefore be formed with a bottom surface having virtually no projecting parts to speak of and which therefore forms an excellent gliding surface due to both its rigidity and its smooth contour.

In one advantageous embodiment, the rigid base sections are made from epoxy resin reinforced with carbon fibres. A base made in this way is still relatively light and acceptable in terms of cost whilst being extremely robust.

So that the craft is as compact and requires as little space as possible once deflated and folded, it is desirable to provide a rigid seat, which detachably hooks onto anchoring points at either side, provided respectively on the two side pieces.

In order to reinforce the transverse rigidity of the kayak and support the covering canvas correctly in a slightly rounded position with the convex aspect facing upwards, it is useful to provide transverse rigid arches underneath the covering canvas so as to support the latter and span the top edges of the inflatable sides; this being the case, so as not to hamper the user, one specific arch is located in front of the opening and the bottom edge of this specific arch has two cut-out sections in which the knees of the user can be placed and supported.

Also to improve the comfort of the user, one section of the rigid keel located in front of the seat supports an axially adjustable foot-rest.

In one specific embodiment, the base is divided into four sections placed end-to-end and hinge-mounted one with the other, this sub-division of the base representing a good comprise and providing sections of reasonable dimensions that will fit in a bag, whilst not being too great in number, and reducing the number of water-tight connections between them. In this design, once the sides have been deflated and the seat, tensioning frame, specific arch and keel sections dismantled, the kayak folds down on itself in a zigzag design and, once folded, the entire kayak and its dismantled accessories will fit in a back-pack that can be carried by one person.

BRIEF DESCRIPTION OF THE DRAWINGS

The invention will be more readily understood from the detailed description below which represents a preferred embodiment, given by way of illustration only. Throughout this description, reference will be made to the drawings, in which.

DETAILED DESCRIPTION OF THE INVENTION

Figure 1:
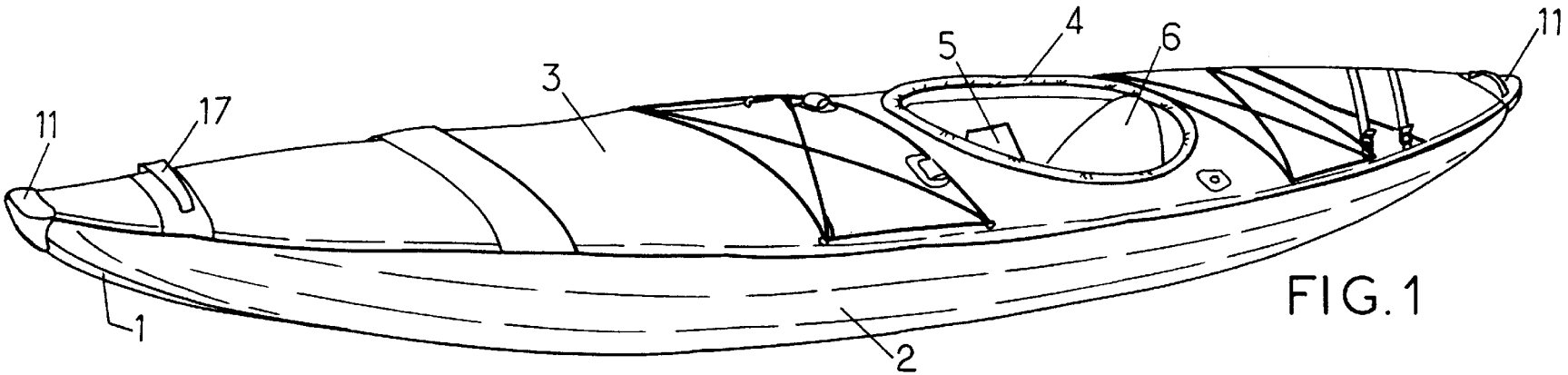
FIG. 1 is an overall perspective view of a kayak of a design proposed by the invention.

Turning firstly to FIG. 1, the kayak proposed by the invention comprises a rigid base 1 (barely visible in FIG. 1), two pneumatically inflatable side pieces 2 which are joined at the bottom to the longitudinal edges of the rigid base 1, a covering canvas 3 joined to the respective top longitudinal edges of the two inflatable side pieces 2, said covering canvas 3 having at least one opening 4 for a user, and a seat 5 located under said opening 4, FIG. 1 also showing a back-rest 6 partially engaged in the opening 4.

Figure 2:
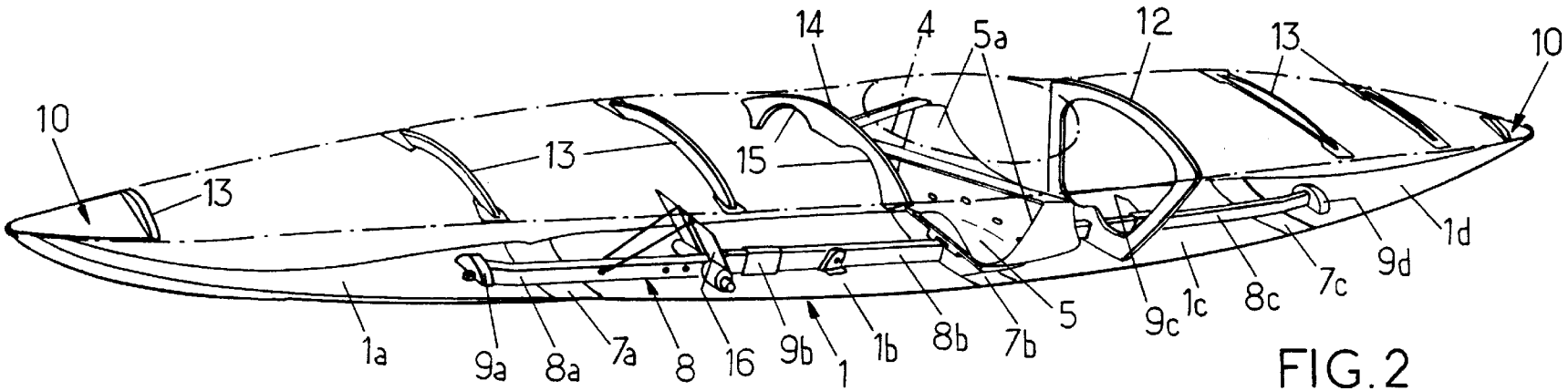
FIG. 2 is a perspective view of the kayak illustrated in FIG. 1 with the inflatable sides and the flexible top removed so as to show the rigid elements only, the upper contour of the craft being illustrated by a dotted-dashed line.

As may be seen more clearly from FIG. 2, the rigid base 1 is made up of several sections placed end-to-end (in this case there are four sections 1*a* to 1*d*, this design being a preferred embodiment striking a good compromise between providing a large number of sections, which are short and easy to carry but which require numerous joints incurring the risk of leaks and a smaller number of sections which are long and not so easy to carry). The sections 1*a*–1*d* are made from a lightweight rigid material which will not deteriorate, particularly in contact with seawater. Advantageously, they are made from epoxy resin reinforced with carbon fibres.

Sections 1*a* to 1*d* are joined to one another so as to be water-tight and can be folded one on top of the other. One particularly advantageous way of providing these water-tight joints 7*a* to 7*c* is to make them in the form of strips of impermeable fabric joined (in particular bonded) to the adjacent edges of two consecutive base sections. These strips may be layered (one on the interior and one on the exterior) and straddle the ends of the sections. This will provide flexible joints having virtually no areas projecting out from the faces of the base section, thereby specifically obtaining a practically smooth external surface that will glide perfectly on water.

The base sections 1*a* to 1*d* are individually shaped so that the base represents a longitudinally streamlined shape with the ends (sections 1*a* and 1*d*) tapering to a point and slightly raised. Furthermore, with the exception of the ends, the rigid base 1 is of a generally flat shape, only the two longitudinal edges being slightly raised to facilitate the joint with the two sides.

In order to keep the base sections 1*a* to 1*d* locked in the deployed position, a rigid keel 8 is provided, detachably fixed to said sections, on the upper faces thereof This keel is made from a piece of wood which, because of its considerable length, would be too cumbersome and not easy to carry if it were in a single piece. Consequently, it is made from several sections, in this case sections 8*a* to 8*c*, arranged end to end and retained in brackets, four of them 9*a*–9*d* in this case, attached to the upper face of the base sections 1*a*–1*d*. The two end brackets 9*a* and 9*d* are closed so that they will act as axial stops for the keel 8 whilst the intermediate brackets 9*b*–9*c* define tubular passages, in each of which the ends of two consecutive keel sections are placed end to end.

As a result of this design, each keel section 8*a*–8*c* straddles a hinge 7*a*–7*c*, preventing any movement therein and retaining the two consecutive base sections in axial alignment with one another.

Each side 2 is provided as a pneumatically inflatable structure, preferably made in the form of tubes one above the other (three tubes in the example illustrated here), of a shape and design familiar to the person skilled in the art, particularly as regards inflation, the optional provision of independent compartments, etc. . . These tubes are individually shaped so that the ends of each side are streamlined in shape and join perfectly with the raised ends of the base 1.

Furthermore, the two sides, conforming to the streamlined shape of the ends of the base 1, run together, specifically to form a bow at the front.

In order to mechanically reinforce the two end tips and strengthen the triple link between the two sides 2 and the covering canvas 3, a rigid reinforcing piece 10 is provided, with the external appearance of a nose 11 forming a bead, to which piece 10 the ends of the sides 2 and the covering canvas 3 are joined.

At least one rigid tensor 12 is provided in order to strengthen the central region, arranged transversely to the rear of the seat and peripherally shaped so as to support the two inflatable sides 2 from the side and the canvas covering 3 at the top. In the case of a two-man kayak which will have two openings 4 arranged one behind the other (not illustrated), two tensioning frames 12 are provided, arranged respectively to the rear of the two openings 4. The tensioning frame 12 is detachably fixed to the keel 8; its bottom cross-piece may have an opening, for example, through which the corresponding keel section is inserted.

In addition, the seat 5 is rigid and made from synthetic material in the form of a moulded shell. This shell has two vertical, lateral uprights 5*a* which can be detachably hooked into anchoring points at either side (not visible), provided on the respective internal faces of the inflatable sides 2. Designed in this manner, the seat 5 also helps to brace the central region of the inflatable sides 2 in conjunction with the tensioning frame 12, immediately adjacent to it to the rear.

Rigid arches 13 are provided in order to support the covering canvas 3 and brace the top edges of the inflatable sides 2. These arches 13 may be incorporated in the covering canvas 3 or may be attached to the top edges of the inflatable sides 2, by means of brackets fixed to these edges, for example.

One specific rigid arch 14 is provided on the front of the opening 4, which may be of the detachable type and which has a bottom edge with two cut-out sections 15 side by side for the user's knees and shaped so that the user can support his legs against this arch if necessary.

The kayak proposed by the invention may otherwise be fitted with any equipment needed for its use.

In particular, an axially adjustable foot-rest 16 may be detachably fixed to the keel 8. For example, as illustrated in FIG. 2, a keel section 8*a* located in front of the seat 5 has several transverse orifices spaced axially at a distance apart from one another and the foot-rest has a pin which locates in one of the holes at the desired point.

A handle 17 for carrying and dragging may be provided at one end or both ends, joined to the covering canvas 3.

One or two fixing points for packages can be provided on the covering canvas in front of and/or behind the opening 4 and approximately flush with the specific arch 14 and/or the tensioning frame 12.

The opening 4 may be arranged in any manner suitable for using the kayak and in particular may be provided with a sealed bellows designed to sit tightly round the body of the user.

Figure 3:
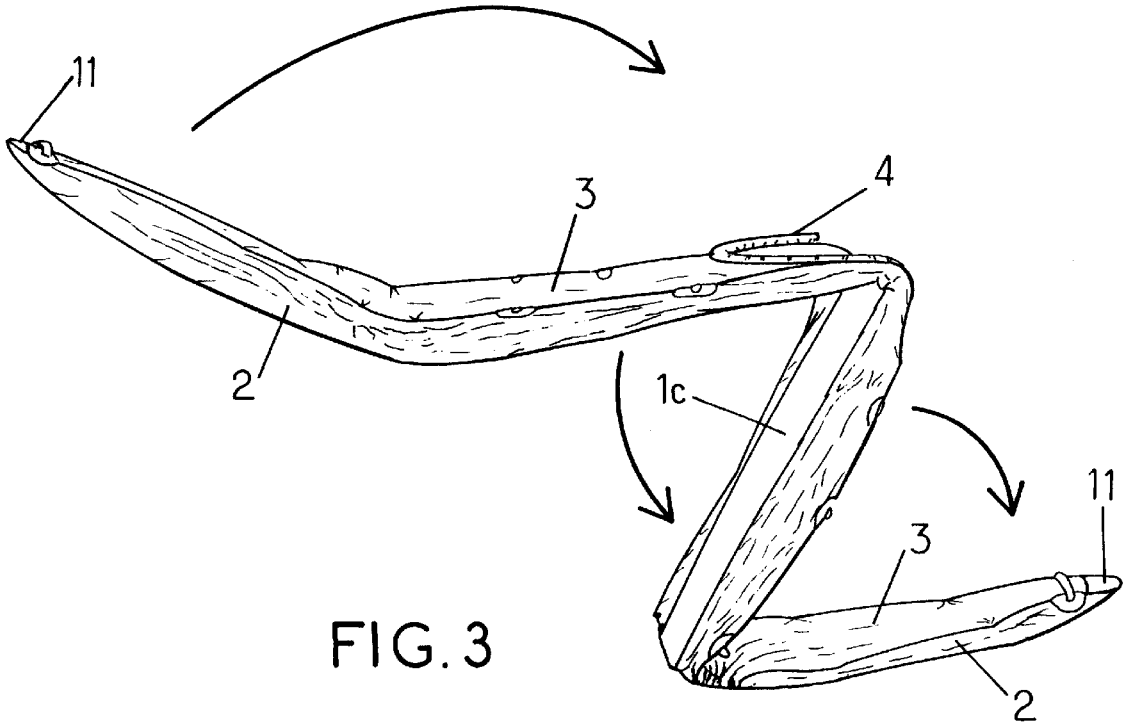
FIG. 3 is a perspective view illustrating the kayak of FIG. 1, deflated and with the fittings removed, in the process of being folded or unfolded.

In a typical embodiment as illustrated in FIGS. 1 to 3, the base 1 is sub-divided into four sections 1*a* to 1*d* and the keel 9 is sub-divided into three sections 9*a* to 9*c*.

A one-man kayak of this design is about 4.50 m in length, approximately 70 cm wide and weighs about 22 kg, its laden weight being in the order of 220 kg.

A kayak of this design as proposed by the invention can be reduced to a very small number of constituent parts which can be dismantled from one another, in this case the kayak itself, which can be deflated and folded, three keel sections 9*a*–9*c*, the tensioning frame 12, the specific arch 14, the seat 5.

FIG. 3 illustrates the kayak in the process of being assembled or dismantled with the sides 2 deflated and the keel sections not assembled. The four base sections can be seen particularly clearly in this drawing, joined by their water-tight links and shown in an angled position.

The kayak itself, once deflated, can be folded in a zigzag design as indicated by the arrows, the four sections being placed one on top of the other with the fabric folded between the sections. The unit forms a compact pack of about 116 cm×55 cm×35 cm which will easily fit, with its dismantled accessories, in a back-pack for one person to carry.

It takes about 10 min. to assemble a one-man kayak of this design compared with about one hour needed to assemble the folding kayaks currently known.

Again by way of example, it would be possible to produce a two-man kayak of the same design, which would be about 5.50 m long, 80 cm wide and weigh about 28 kg, the laden weight being in the order of 350 kg. This kayak would be made of the same parts as the one-man kayak described above but with a second seat and a second tensioning frame. It would take about 13 minutes to assemble.

What is claimed is:

1. A kayak comprising:

a rigid base, made from several sections end-to-end joined to one another in a water-tight hinge-mounting so that they can be folded one on top of the other, a rigid keel made up of several sections spanning the hinge-mountings of the base sections and retained in brackets fixed to said base sections, two pneumatically inflatable side sections joined at the base to the longitudinal edges of the rigid base, a covering canvas joined to the respective top longitudinal edges of the two inflatable sides, said covering canvas having at least one opening for a user, a seat located underneath said opening and at least one rigid tensioning frame arranged at the rear of the opening and designed to brace the base, the inflatable sides and the covering canvas.

2. A kayak as in claim 1, wherein each inflatable side is made up of several tubes arranged one on top of the other.

3. A kayak as in claim 1, wherein the water-tight hinge-mountings of the successive sections of the base are made from impermeable strips of material joined to the adjacent edges of two consecutive sections.

4. A kayak as in claim 1, wherein the rigid sections of the base are made from epoxy resin reinforced with carbon fibres.

5. A kayak as in claim 1, wherein the seat is rigid and is detachably hooked at either side to anchoring points provided respectively on the sides.

6. A kayak as in claim 1, wherein transverse rigid arches are arranged underneath the covering canvas to support the latter and brace the top edges of the inflatable sides.

7. A kayak as in claim 6, wherein a specific arch is arranged in front of the opening and in that the bottom edge of the specific arch has two cut-out sections trough which the knees of the user can be placed and supported.

8. A kayak as in claim 1, wherein a section of the rigid keel located in front of the seat supports an axially adjustable foot-rest.

9. A kayak as in claim 1, wherein the base is divided into four sections end-to-end and rigidly hinge-mounted one with the other.

10. A kayak as in claim 9, wherein once the sides have been deflated and the seat, tensioning frame, specific arch and keel sections dismantled, the kayak can be folded down on itself in a zigzag design and folded kayak assembly and dismantled accessories will fit in a back-pack which can be carried by one person.

* * * * *